US008398386B2

(12) United States Patent
Han et al.

(10) Patent No.: US 8,398,386 B2
(45) Date of Patent: Mar. 19, 2013

(54) 2 STAGE ROTARY COMPRESSOR

(75) Inventors: Jeong-Min Han, Changwon-shi (KR); Sang-Myung Byun, Changwon-shi (KR); Sang-Mo Kim, Changwon-shi (KR); Joon-Hong Park, Changwon-shi (KR)

(73) Assignee: LG Electronics Inc., Seoul (KR)

( * ) Notice: Subject to any disclaimer, the term of this patent is extended or adjusted under 35 U.S.C. 154(b) by 360 days.

(21) Appl. No.: 12/741,913

(22) PCT Filed: Mar. 31, 2008

(86) PCT No.: PCT/KR2008/001799

§ 371 (c)(1),
(2), (4) Date: Jul. 13, 2010

(87) PCT Pub. No.: WO2009/061039

PCT Pub. Date: May 14, 2009

(65) Prior Publication Data

US 2010/0278675 A1 Nov. 4, 2010

(30) Foreign Application Priority Data

Nov. 8, 2007 (KR) ..... 10-2007-0113946

(51) Int. Cl.
*F04C 23/00* (2006.01)

(52) U.S. Cl. ..... 418/7; 418/11; 418/13

(58) Field of Classification Search ..... 418/7, 11, 418/13, 15, 86

See application file for complete search history.

(56) References Cited

U.S. PATENT DOCUMENTS 5,322,424 A 6/1994 Fujio
6,651,458 B1 * 11/2003 Ebara et al. ..... 62/510

FOREIGN PATENT DOCUMENTS

CN 1371453 9/2002

OTHER PUBLICATIONS

Chinese Office Action dated Mar. 5, 2012. (translation).
International Search Report issued in PCT/KR2008/001799 dated Dec. 15, 2008.

* cited by examiner

*Primary Examiner* — Zelalem Eshete
(74) *Attorney, Agent, or Firm* — KED & Associates LLP

(57) ABSTRACT

A 2 stage rotary compressor is provided that includes a hermetic container that defines an outward appearance of the compressor; a 2 stage compression assembly provided in the hermetic container, wherein a low pressure cylinder, a middle plate, and a high pressure cylinder are successively stacked from any one of upper and lower portions; and first discharge port that discharges refrigerant compressed in the low pressure cylinder, and having an inner volume equivalent to 0.5% to 2.5% of an inner volume of the low pressure cylinder. A valve is installed on or under the discharge port. When the valve is opened, compressed refrigerant is discharged through the discharge port. When the valve is closed, refrigerant remains in the discharge port as much as the volume of the discharge port. Accordingly, refrigerant remaining in the discharge port is re-expanded in the cylinder, to thereby cause a compression loss. Moreover, in a case in which the volume of the discharge port is excessively small, a resistance occurs in a refrigerant passage. As a result, the volume of the discharge port should he appropriately restricted.

12 Claims, 11 Drawing Sheets

[Fig. 1]
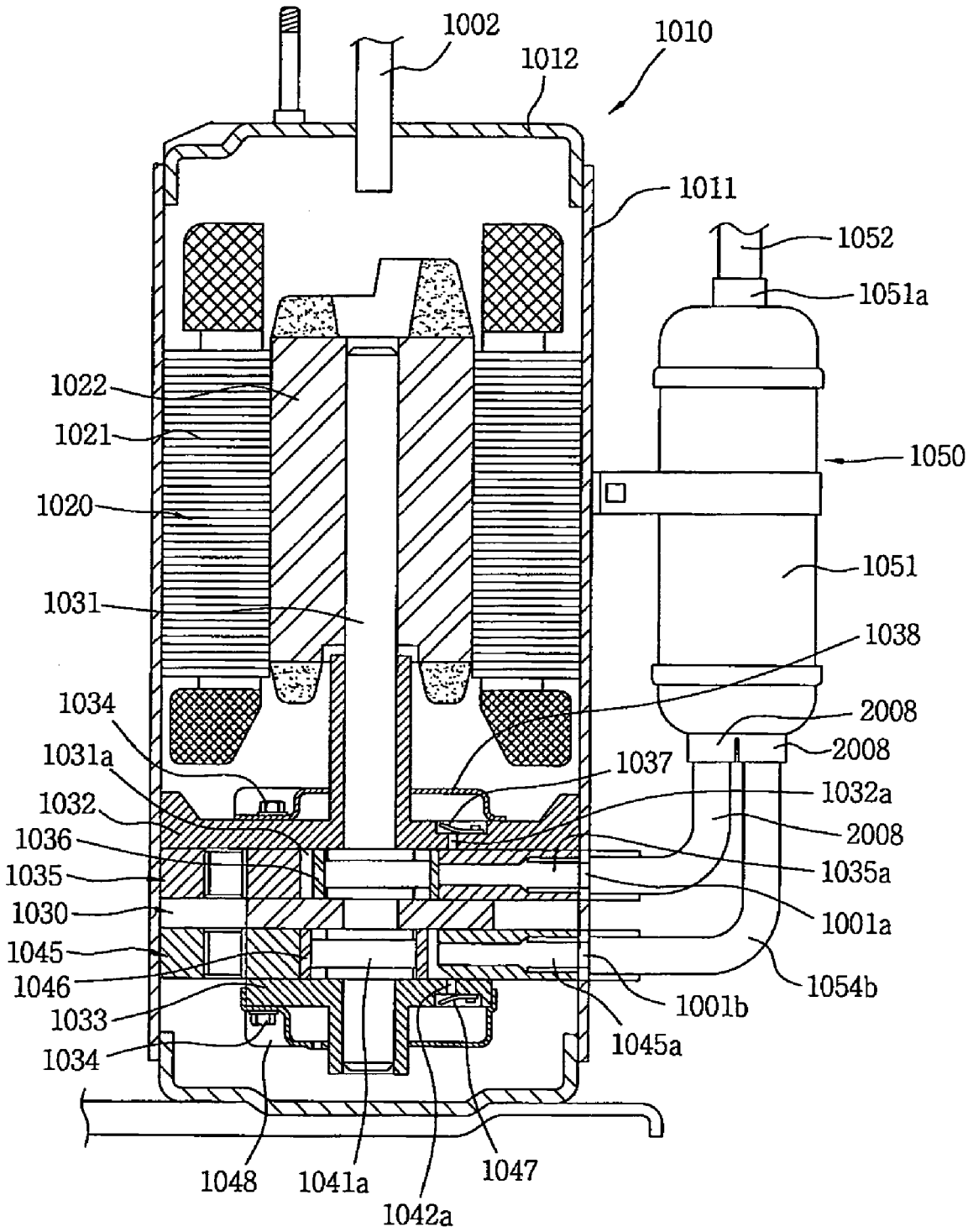

[Fig. 2]
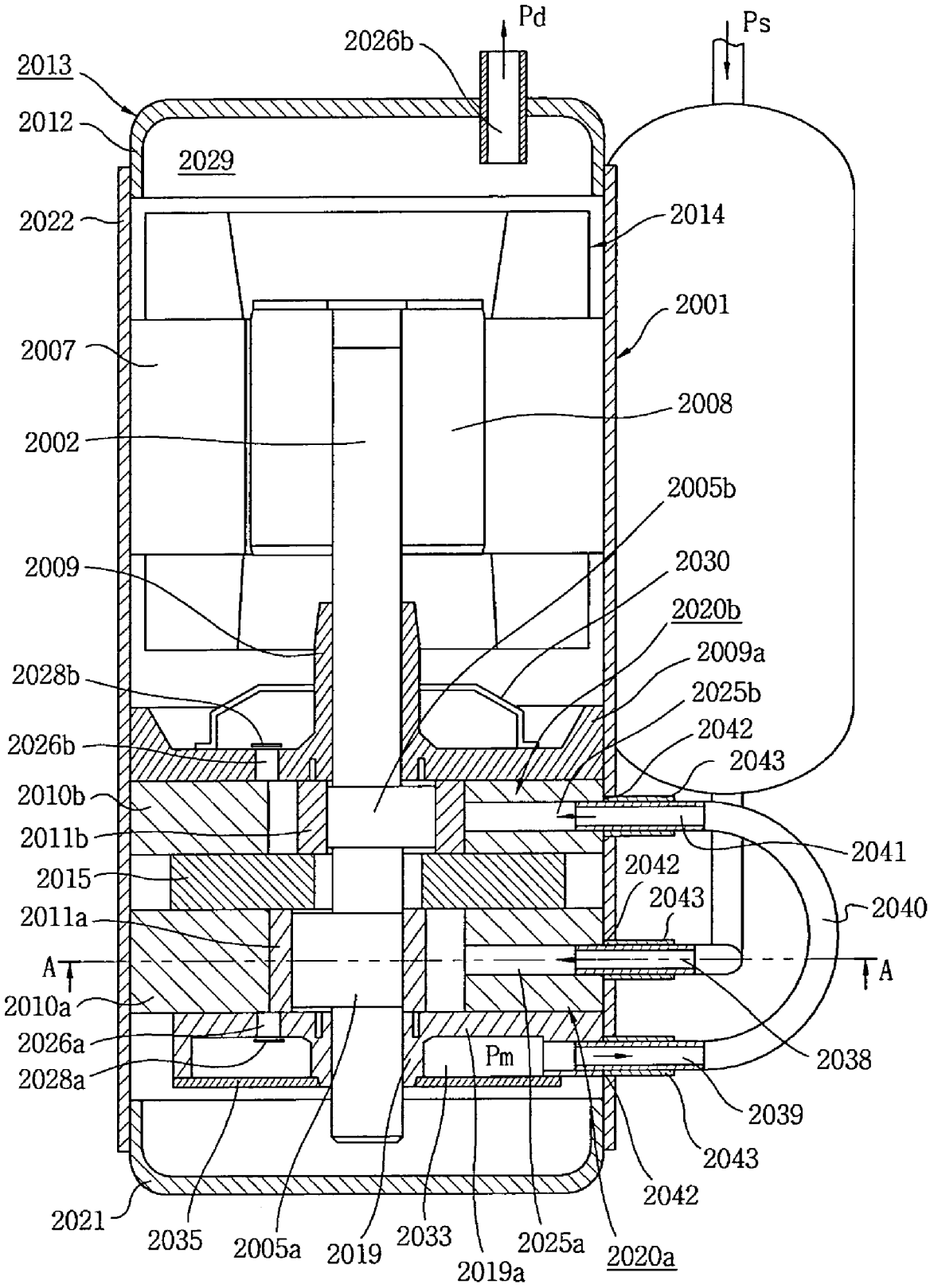

[Fig. 3]
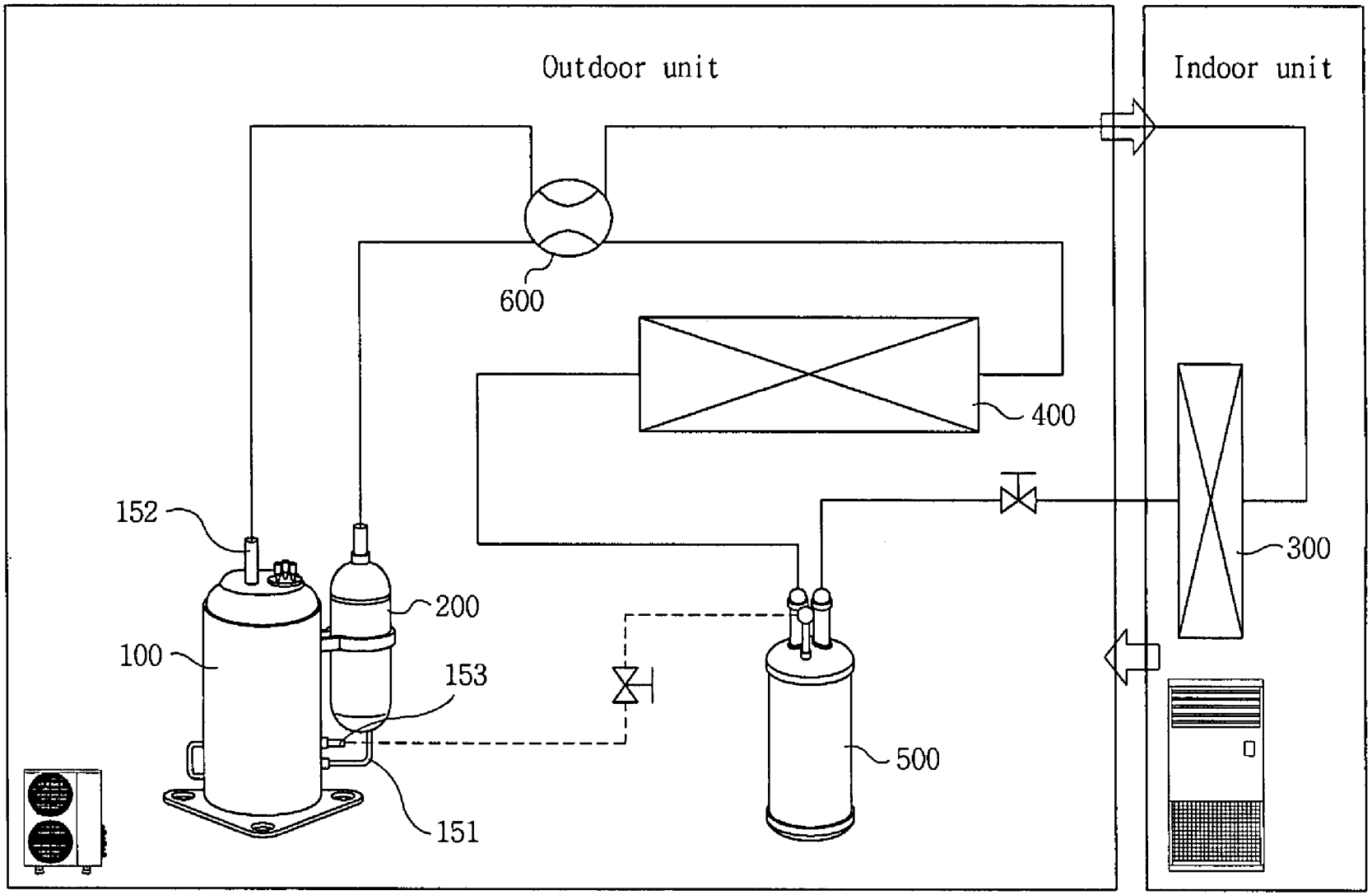

[Fig. 4]
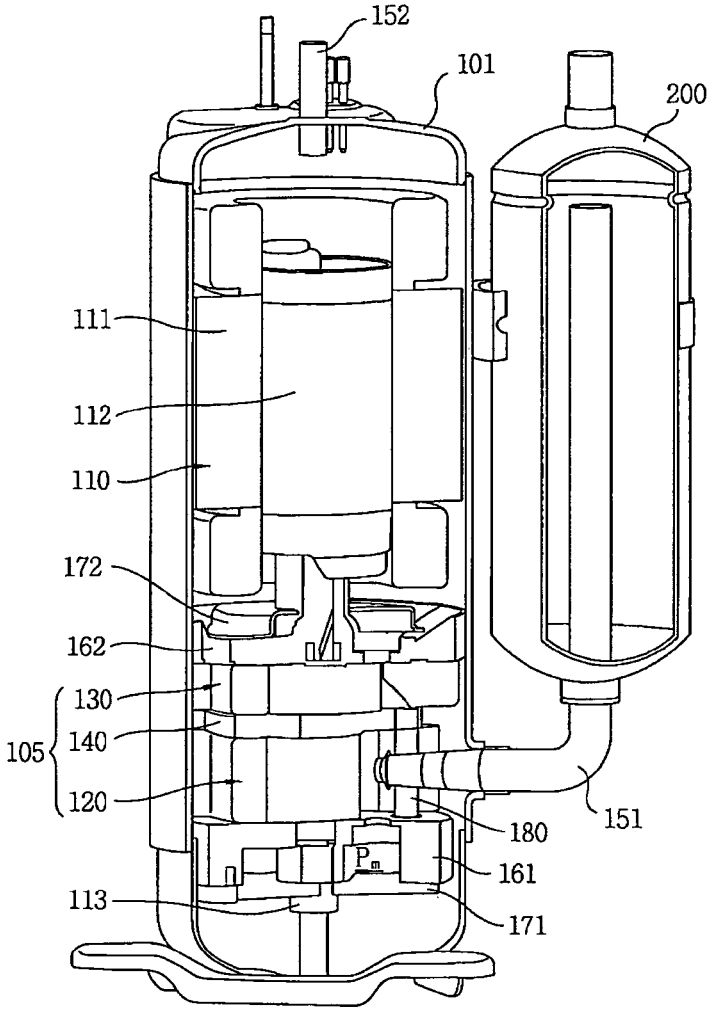
[Fig. 5]
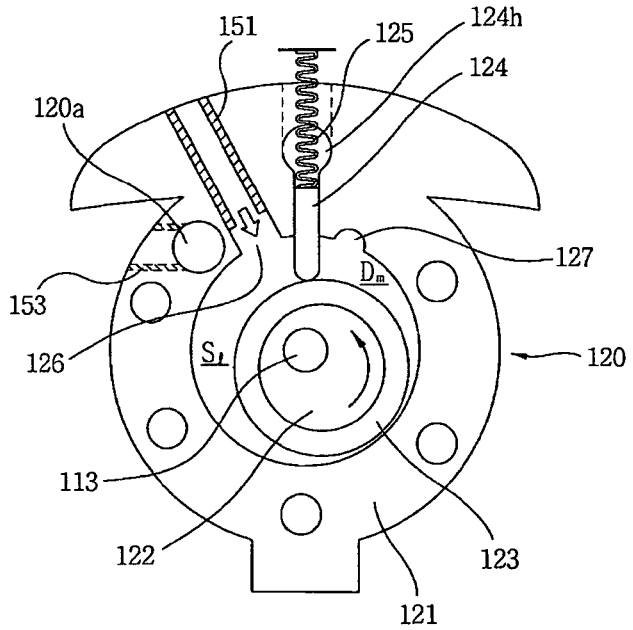

[Fig. 6]
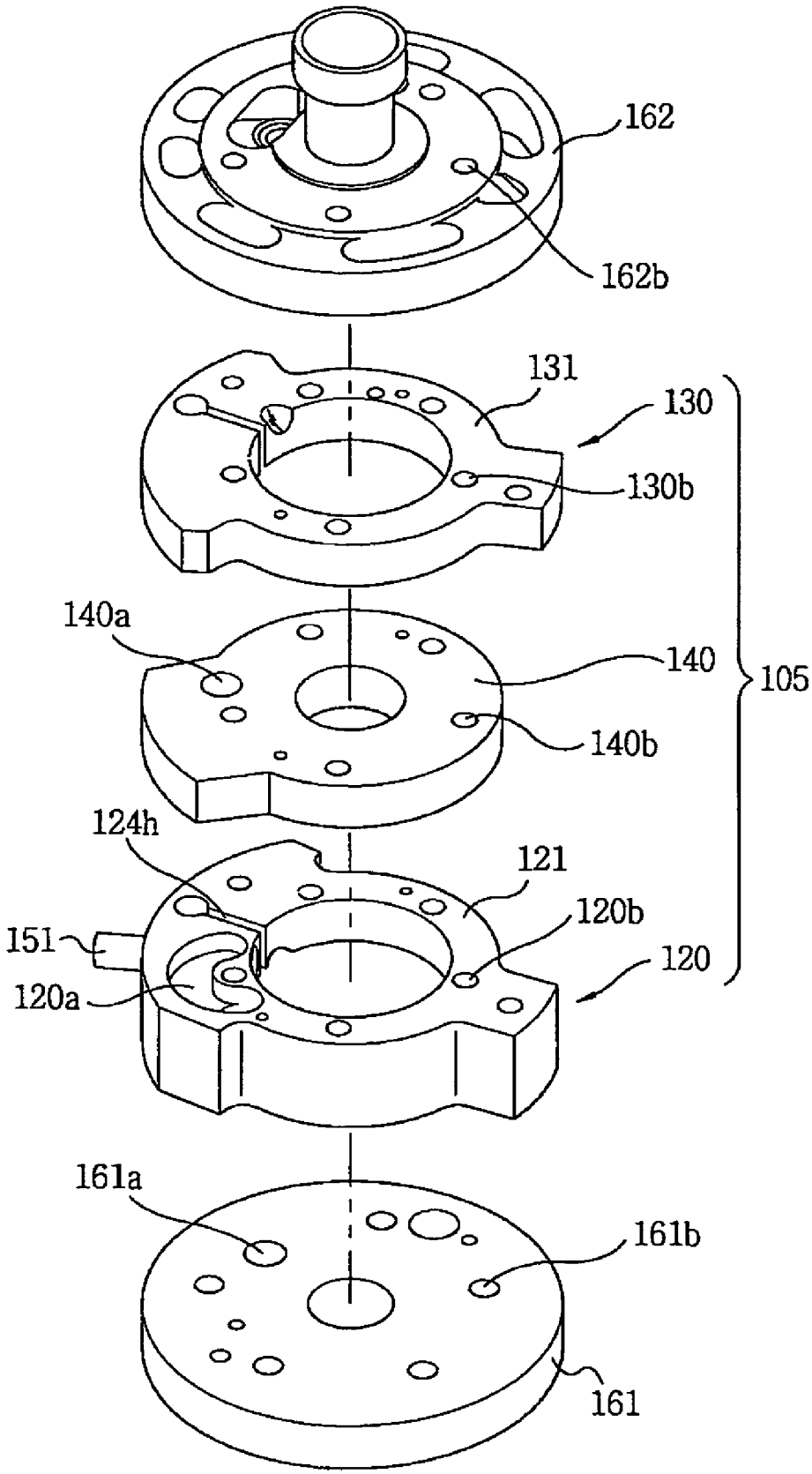

[Fig. 7]
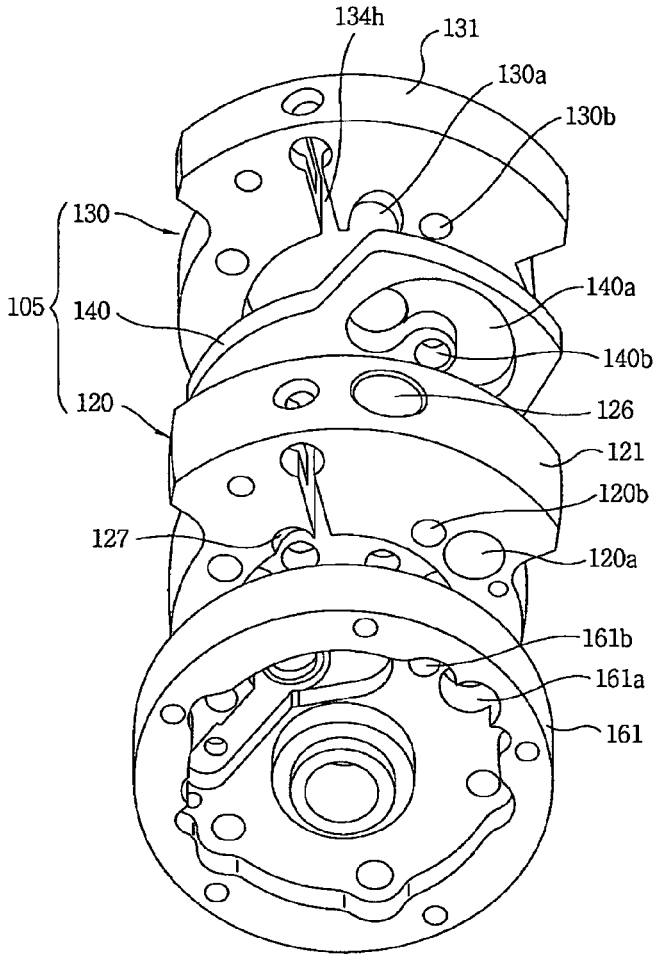
[Fig. 8]
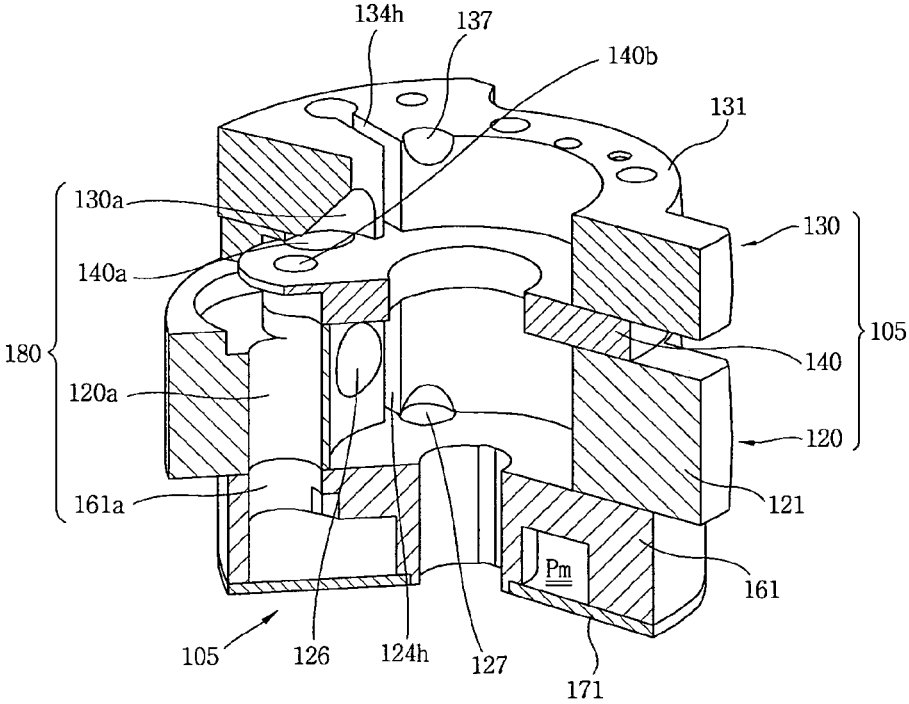

[Fig. 9]
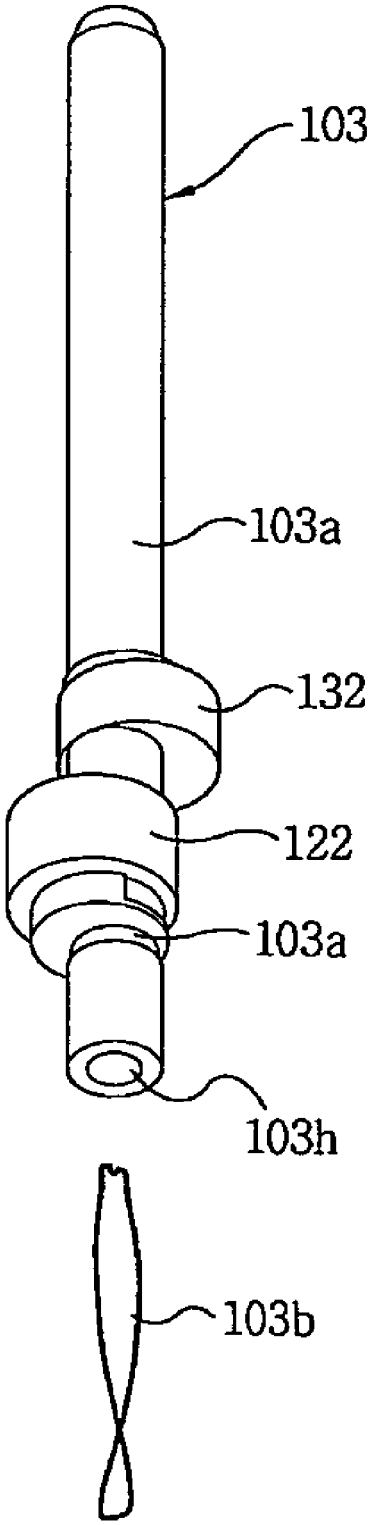

[Fig. 10]
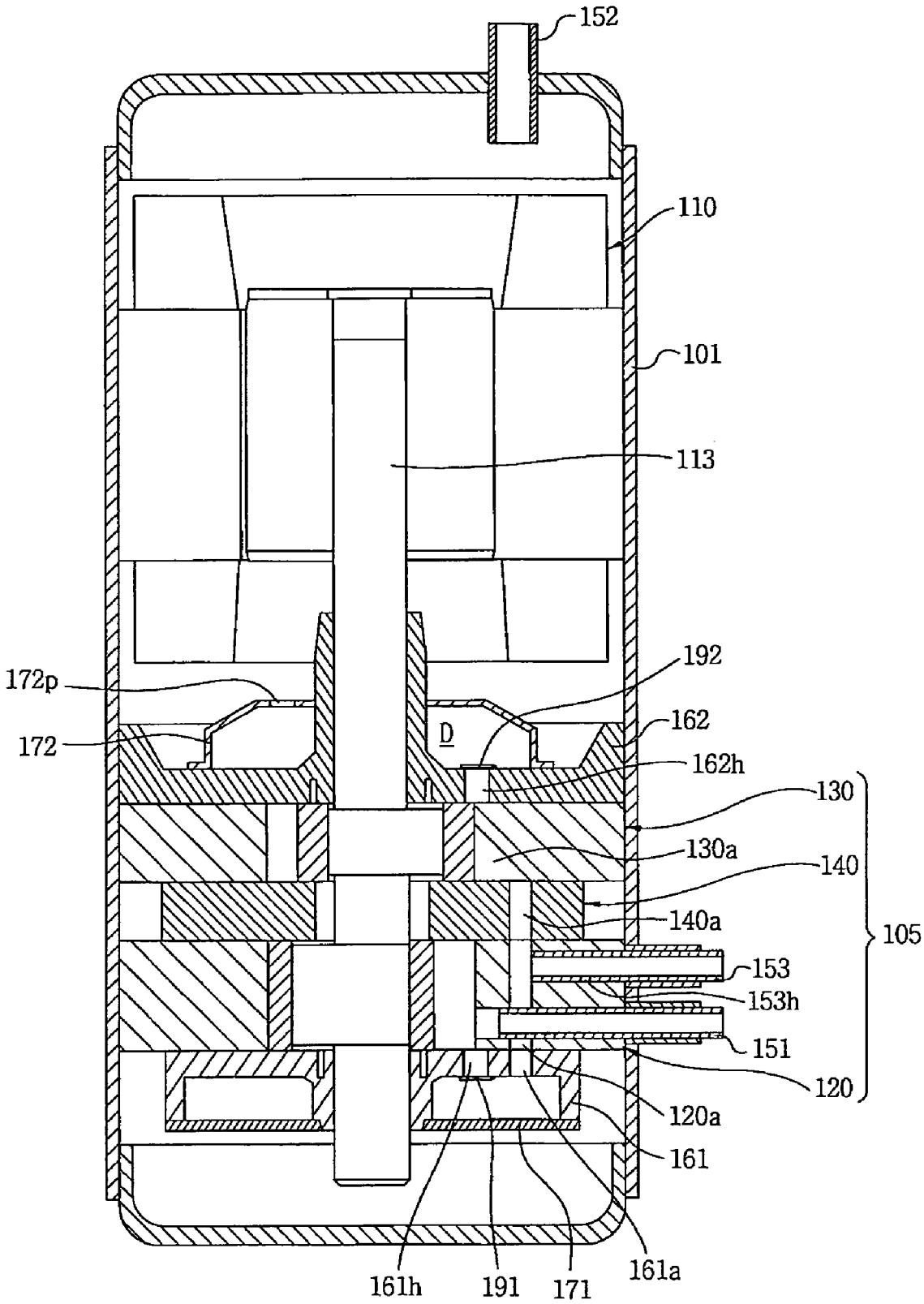

[Fig. 11]
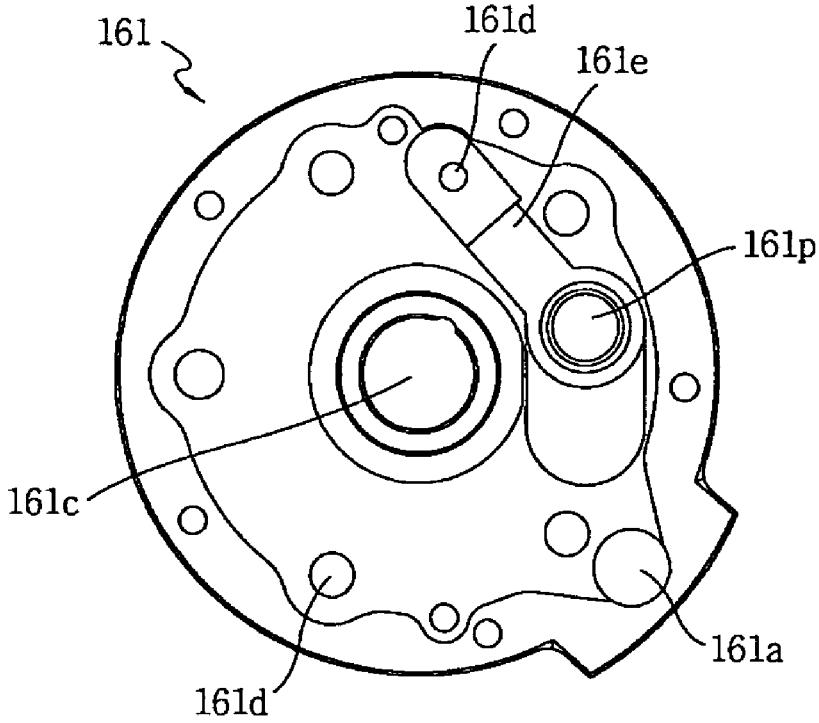
[Fig. 12]
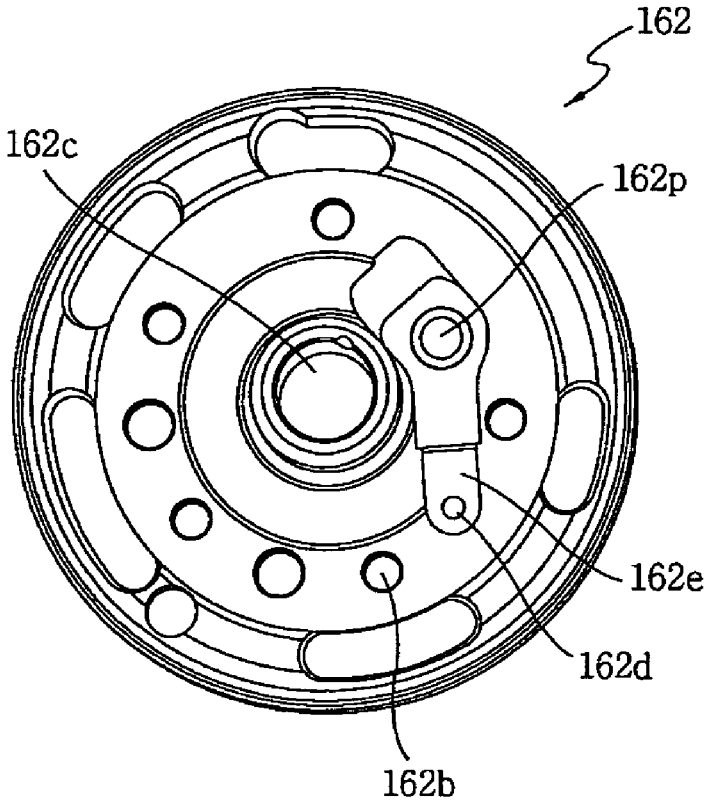

[Fig. 13]
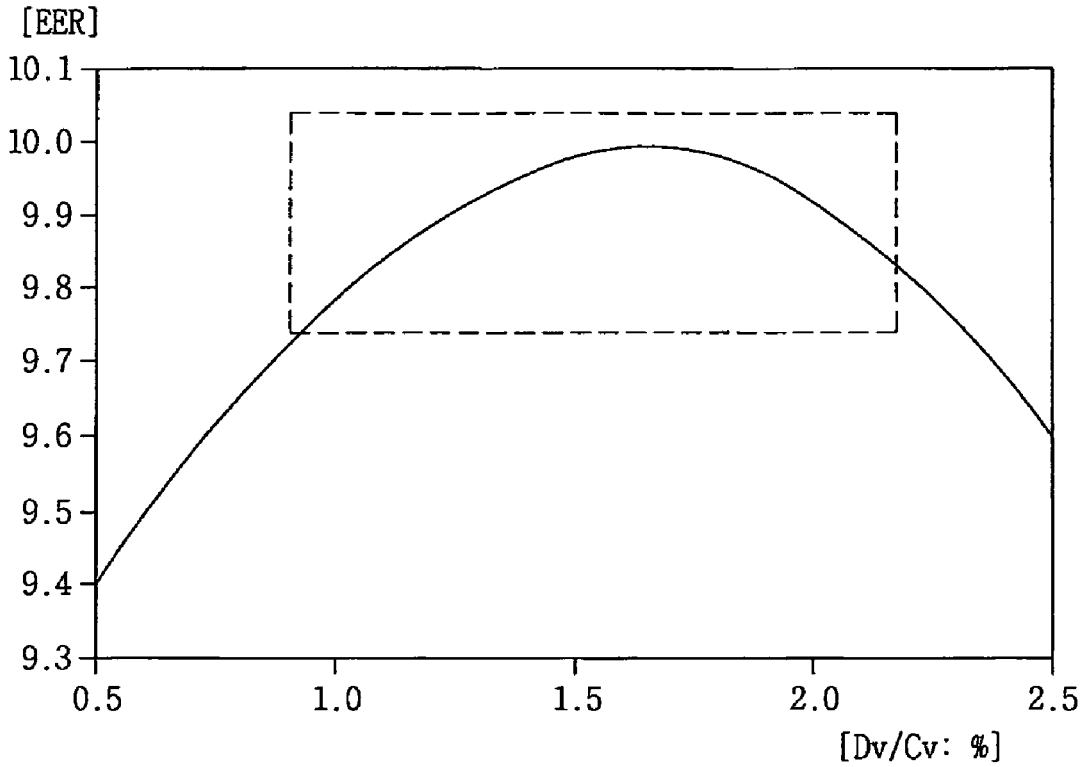
[Fig. 14]
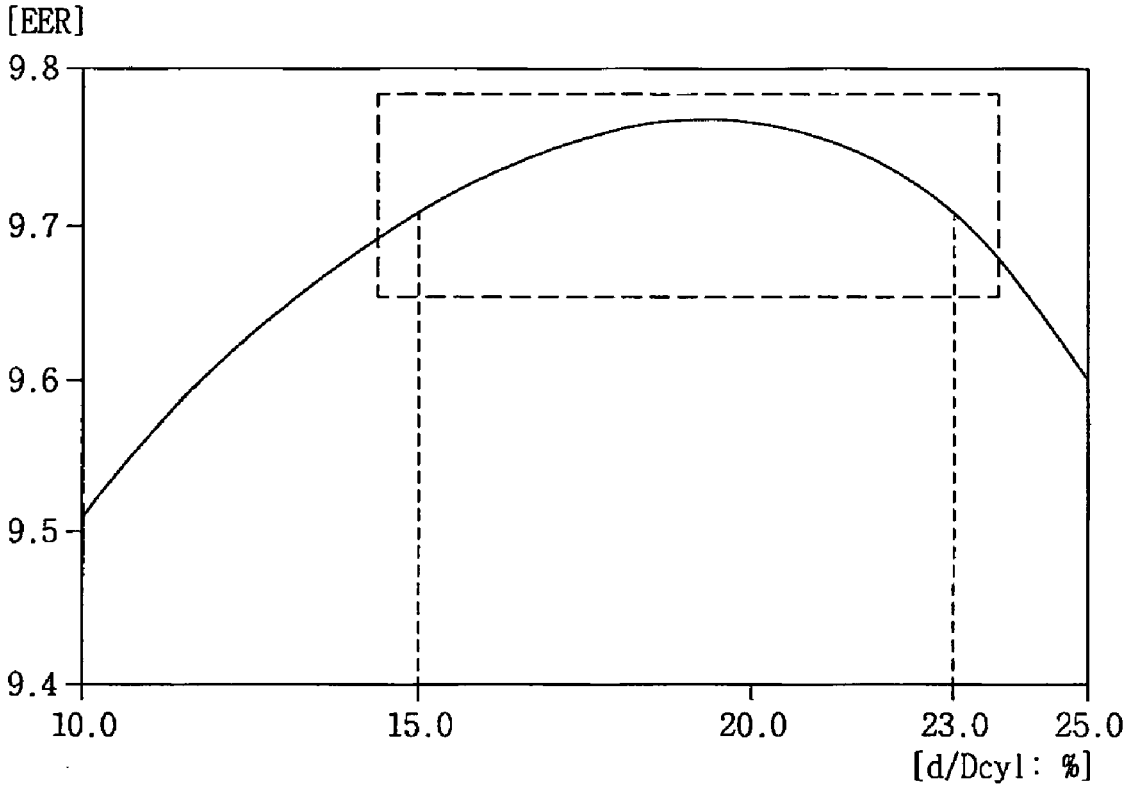

[Fig. 15]
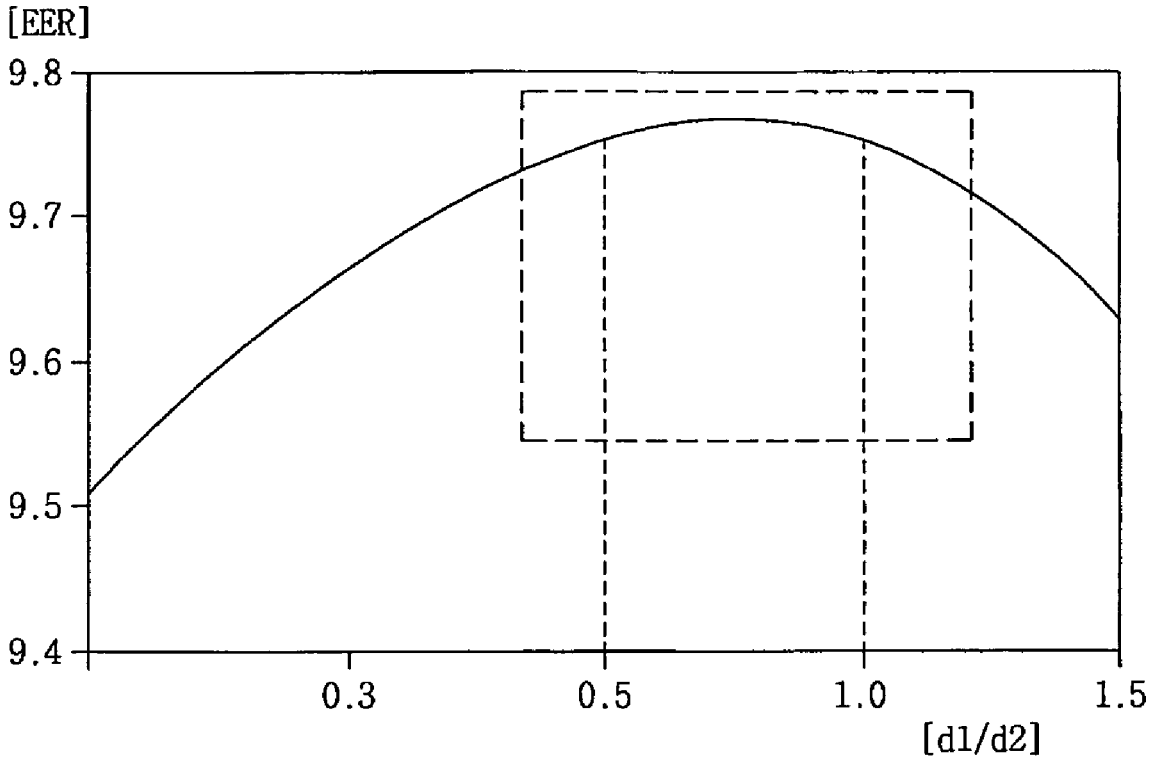

2 STAGE ROTARY COMPRESSOR

TECHNICAL FIELD

The present invention relates to a 2 stage rotary compressor, and more particularly, to a 2 stage rotary compressor, wherein an inner diameter or a volume of a first discharge port discharging refrigerant compressed in a low pressure cylinder and an inner diameter or a volume of a second discharge port discharging refrigerant compressed in a high pressure cylinder are controlled to improve compression efficiency.

BACKGROUND ART

In general, a compressor is a mechanical apparatus that receives power from a power generation apparatus such as an electric motor, a turbine or the like and compresses air, refrigerant or various operation gases to raise a pressure. The compressor has been widely used in an electric home appliance such as a refrigerator and an air conditioner, or in the whole industry.

The compressor is roughly classified into a reciprocating compressor wherein a compression space to/from which an operation gas is sucked and discharged is defined between a piston and a cylinder, and the piston is linearly reciprocated inside the cylinder to compress refrigerant, a rotary compressor wherein a compression space to/from which an operation gas is sucked and discharged is defined between an eccentrically-rotated roller and a cylinder, and the roller is eccentrically rotated along an inner wall of the cylinder to compress refrigerant, and a scroll compressor wherein a compression space to/from which an operation gas is sucked and discharged is defined between an orbiting scroll and a fixed scroll, and the orbiting scroll is rotated along the fixed scroll to compress refrigerant.

Particularly, the rotary compressor has been developed to a twin rotary compressor, wherein two rollers and two cylinders are provided at upper and lower portions, and the pairs of rollers and cylinders of the upper and lower portions compress some and the other of the entire compression capacity, and a 2 stage rotary compressor, wherein two rollers and two cylinders are provided at upper and lower portions, and the two cylinders communicate with each other so that one pair can compress relatively low pressure refrigerant and the other pair can compress relatively high pressure refrigerant passing through a low pressure compression step.

Korean Registered Patent Publication 1994-0001355 discloses a rotary compressor. An electric motor is positioned in a shell, and a rotation axis is installed to pass through the electric motor. In addition, a cylinder is positioned below the electric motor, and an eccentric portion fitted around the rotation axis and a roller fitted onto the eccentric portion are positioned in the cylinder. A refrigerant discharge hole and a refrigerant inflow hole are formed in the cylinder, and a vane for preventing non-compressed low pressure refrigerant from being mixed with compressed high pressure refrigerant is installed between the refrigerant discharge hole and the refrigerant inflow hole. Moreover, a spring is installed at one end of the vane so that the eccentrically-rotated roller and the vane can be continuously in contact with each other. When the rotation axis is rotated by the electric motor, the eccentric portion and the roller are rotated along the inner circumference of the cylinder to compress refrigerant gas, and the compressed refrigerant gas is discharged through the refrigerant discharge hole.

Korean Laid-Open Patent Publication 10-2005-0062995 suggests a twin rotary compressor. Referring to FIG. 1, two cylinders 1035 and 1045 for compressing the same capacity and a middle plate 1030 are provided to improve a compression capacity twice as much as that of an 1 stage compressor.

Korean Laid-Open Patent Publication 10-2007-0009958 teaches a 2 stage rotary compressor. As illustrated in FIG. 2, a compressor 2001 includes an electric motor 2014 having a stator 2007 and a rotor 2008 at an inside upper portion of a hermetic container 2013, and a rotation axis 2002 connected to the electric motor 2014 includes two eccentric portions. A main bearing 2009, a high pressure compression element 2020*b*, a middle plate 2015, a low pressure compression element 2020*a* and a sub bearing 2019 are successively stacked from the side of the electric motor 2014 with respect to the rotation axis 2002. In addition, a middle tube 2040 is installed to introduce refrigerant compressed in the low pressure compression element 2020*a* into the high pressure compression element 2020*b*.

DISCLOSURE OF INVENTION

Technical Problem

An object of the present invention is to provide a 2 stage rotary compressor, wherein an inner diameter and a volume of a first discharge port discharging refrigerant compressed in a low pressure cylinder and an inner diameter and a volume of a second discharge port discharging refrigerant compressed in a high pressure cylinder are restricted to implement the optimum performance.

Another object of the present invention is to provide a 2 stage rotary compressor, wherein an inner diameter ratio between a first discharge port and a second discharge port is restricted to implement the optimum performance.

Technical Solution

According to the present invention, there is provided a 2 stage rotary compressor, inducing: a hermetic container defining an outward appearance of the compressor; a 2 stage compression assembly provided in the hermetic container, wherein a low pressure cylinder, a middle plate and a high pressure cylinder are successively stacked from any one of upper and lower portions; a first discharge port for discharging refrigerant compressed in the low pressure cylinder; and a second discharge port for discharging refrigerant compressed in the high pressure cylinder, wherein a diameter of the second discharge port ranges from 0.5 times to 1.0 times of a diameter of the first discharge port. In the 2 stage rotary compressor, a volume flow of refrigerant compressed in the low pressure cylinder is larger than a volume flow of refrigerant compressed in the high pressure cylinder. Accordingly, the diameter of the first discharge port is preferably larger than or at least equal to the diameter of the second discharge port. In addition, in a case where the diameter of the second discharge port is excessively small, a flow resistance of compressed refrigerant seriously increases. Therefore, the diameter of the second discharge port is preferably at least 0.5 times of the diameter of the first discharge port.

According to one aspect of the present invention, the first discharge port has an inner volume equivalent to 0.5% to 2.5% of an inner volume of the low pressure cylinder. A valve is installed on or under the discharge port. When the valve is opened, compressed refrigerant is discharged through the discharge port. Thereafter, when the valve is closed, refrigerant remains in the discharge port as much as the volume of the discharge port. Accordingly, refrigerant remaining in the discharge port is re-expanded in the cylinder to thereby cause a compression loss. Moreover, in a case where the volume of the discharge port is excessively small, a resistance occurs in a refrigerant passage. As a result, the volume of the discharge port should be appropriately restricted.

According to another aspect of the present invention, the first discharge port has an inner volume equivalent to 1.0% to 2.0% of an inner volume of the low pressure cylinder.

According to a further aspect of the present invention, the first discharge port has an inner diameter equivalent to 10% to 25% of an inner diameter of the low pressure cylinder.

According to a still further aspect of the present invention, the first discharge port has an inner diameter equivalent to 15% to 23% of an inner diameter of the low pressure cylinder.

According to a still further aspect of the present invention, the second discharge port has an inner volume equivalent to 0.5% to 2.5% of an inner volume of the high pressure cylinder.

According to a still further aspect of the present invention, the second discharge port has an inner volume equivalent to 1.0% to 2.0% of an inner volume of the high pressure cylinder.

According to a still further aspect of the present invention, the second discharge port discharges refrigerant compressed in the high pressure cylinder, and has an inner diameter equivalent to 10% to 25% of an inner diameter of the high pressure cylinder.

According to a still further aspect of the present invention, the second discharge port has an inner diameter equivalent to 15% to 23% of an inner diameter of the high pressure cylinder.

According to a still further aspect of the present invention, the 2 stage rotary compressor further includes a first bearing positioned at any one of upper and lower portions of the low pressure cylinder, wherein the first discharge port is formed in the first bearing. In this configuration, the first bearing successively stacked on the low pressure cylinder can support the 2 stage compression assembly, and the first discharge port discharging refrigerant compressed in the low pressure cylinder can be formed in the first bearing.

According to a still further aspect of the present invention, the 2 stage rotary compressor further includes a second bearing positioned at any one of upper and lower portions of the high pressure cylinder, wherein the second discharge port is formed in the second bearing.

Advantageous Effects

According to a 2 stage rotary compressor of the present invention, a ratio of a volume of a discharge port to a volume of a cylinder compressing refrigerant is controlled to be smaller than a predetermined upper limit value, thereby reducing an amount of compressed refrigerant which is not discharged but left in the discharge port in a discharge stroke of a compression assembly. Therefore, a loss caused by re-expansion of compressed refrigerant can be reduced.

In addition, according to a 2 stage rotary compressor of the present invention, a ratio of a volume of a discharge port to a volume of a cylinder compressing refrigerant is controlled to be larger than a predetermined lower limit value, thereby suppressing a flow resistance in a discharge stroke of a compression assembly. Accordingly, efficiency degrading caused by the flow resistance can be prevented.

Moreover, according to a 2 stage rotary compressor of the present invention, an inner diameter ratio between a first discharge port and a second discharge port is controlled to exist within a predetermined range. As a result, improved is efficiency of the 2 stage rotary compressor, wherein a volume flow of refrigerant passing through the first discharge port is larger than a volume flow of refrigerant passing through the second discharge port.

BRIEF DESCRIPTION OF THE DRAWINGS

FIG. 1 is a view illustrating one example of a conventional twin rotary compressor;

FIG. 2 is a view illustrating one example of a conventional 2 stage stage rotary compressor;

FIG. 3 is a schematic view illustrating one example of a cycle inducing a 2 stage rotary compressor;

FIG. 4 is a view illustrating a 2 stage rotary compressor according to one embodiment of the present invention;

FIG. 5 is a view illustrating a low pressure compression assembly of the 2 stage rotary compressor according to one embodiment of the present invention;

FIGS. 6 and 7 are views illustrating portions of the 2 stage rotary compressor according to one embodiment of the present invention, seen from the top and bottom, respectively;

FIG. 8 is a cutaway view illustrating the 2 stage rotary compressor according to one embodiment of the present invention;

FIG. 9 is a view illustrating one example of a rotation axis provided in the 2 stage rotary compressor according to one embodiment of the present invention;

FIG. 10 is a view illustrating a 2 stage rotary compressor with an injection tube installed therein according to one embodiment of the present invention;

FIG. 11 is a view illustrating a lower bearing having a first discharge port according to one embodiment of the present invention;

FIG. 12 is a view illustrating an upper bearing having a second discharge port according to one embodiment of the present invention;

FIG. 13 is a graph showing an energy efficiency ratio (EER) of the compressor by a ratio of a volume of the discharge port to a volume of the cylinder;

FIG. 14 is a graph showing an EER of the compressor by a ratio of an inner diameter of the discharge port to an inner diameter of the cylinder; and FIG. 15 is a graph showing an EER of the compressor by a ratio of an inner diameter of the first discharge port to an inner diameter of the second discharge port.

MODE FOR THE INVENTION

Hereinafter, preferred embodiments of the present invention will be described in detail with reference to the accompanying drawings.

FIG. 3 is a schematic view illustrating one example of a cycle inducing a 2 stage rotary compressor according to the present invention. The freezing cycle includes a 2 stage rotary compressor 100, a condenser 300, an evaporator 400, a phase separator 500, a 4 way valve 600, etc. The condenser 300 constitutes an indoor unit, and the compressor 100, the evaporator 400 and the phase separator 500 constitute an outdoor unit. Refrigerant compressed in the compressor 100 is introduced into the condenser 300 through the 4 way valve 600. The compressed refrigerant gas exchanges heat with the ambient air and is condensed. The condensed refrigerant becomes a low pressure through an expansion valve. The refrigerant passing through the expansion valve is separated into gas and liquid in the phase separator 500. The liquid flows into the evaporator 400. The liquid is heat-exchanged and evaporated in the evaporator 400, introduced into an accumulator 200 in a gas phase, and transferred from the accumulator 200 to a low pressure compression assembly (not shown) through a refrigerant inflow tube 151 of the compressor 100. In addition, the gas separated in the phase separator 500 is introduced into the compressor 100 through an injection tube 153. Middle pressure refrigerant compressed in the low pressure compression assembly of the compressor 100 and refrigerant transferred through the injection tube 153 are supplied to a high pressure compression assembly (not shown) of the compressor, compressed to a high pressure, and discharged to the outside of the compressor 100 through a refrigerant discharge tube 152.

FIG. 4 is a view illustrating the 2 stage rotary compressor according to one embodiment of the present invention. The 2 stage rotary compressor 100 according to one embodiment of the present invention includes a low pressure compression assembly 120, a middle plate 140, a high pressure compression assembly 130 and an electric motor 110 in a hermetic container 101 from the bottom. In addition, the 2 stage rotary compressor 100 includes a refrigerant inflow tube 151 connected to an accumulator 200, and a refrigerant discharge tube 152 for discharging compressed refrigerant to the outside of the hermetic container 101, which pass through the hermetic container 101.

The electric motor 110 includes a stator 111, a rotor 112 and a rotation axis 113. The stator 111 has a lamination of ring-shaped electronic steel plates and a coil wound around the lamination. The rotor 112 also has a lamination of electronic steel plates. The rotation axis 113 passes through a center of the rotor 112 and is fixed to the rotor 112. When a current is applied to the electric motor 110, the rotor 112 is rotated due to a mutual electromagnetic force between the stator 111 and the rotor 112, and the rotation axis 113 fixed to the rotor 112 is rotated with the rotor 112. The rotation axis 113 is extended from the rotor 112 to the low pressure compression assembly 120 to pass through the central portions of the low pressure compression assembly 120, the middle plate 140 and the high pressure compression assembly 130.

The low pressure compression assembly 120 and the high pressure compression assembly 130 may be stacked with the middle plate 140 positioned therebetween in the order of the low pressure compression assembly 120—the middle plate 140—the high pressure compression assembly 130 from the bottom. On the contrary, the low pressure compression assembly 120 and the high pressure compression assembly 130 may be stacked in the order of the high pressure compression assembly 130—the middle plate 140—the low pressure compression assembly 120 from the bottom. In addiction, a lower bearing 161 and an upper bearing 162 are installed under and on the stacked assembly, regardless of the stacked order of the low pressure compression assembly 120, the middle plate 140 and the high pressure compression assembly 130 so as to facilitate the rotation of the rotation axis 113 and support load of respective vertically-stacked components of the 2 stage compression assembly.

The refrigerant inflow tube 151 passing through the hermetic container 101 from the outside is connected to the low pressure compression assembly 120. Moreover, the lower bearing 161 and a lower cover 171 are positioned under the low pressure compression assembly 120. A middle pressure chamber $P_m$ is defined between the lower bearing 161 and the lower cover 171. The middle pressure chamber $P_m$ is a space to which refrigerant compressed in the low pressure compression assembly 120 is discharged, and a space in which refrigerant is temporarily stored before it is introduced into the high pressure compression assembly 130. The middle pressure chamber $P_m$ serves as a buffering space on a passage of flowing refrigerant from the low pressure compression assembly 120 to the high pressure compression assembly 130.

A structure of defining the middle pressure chamber $P_m$ at the lower bearing 161 will be explained. For example, in the lower bearing 161, a central portion into/in which the rotation axis 113 is inserted or installed and a peripheral portion which is in contact with the lower cover 171 protrude in a downward direction, respectively. The lower cover 171 is formed in the shape of a flat plate, provided with a hole through which the rotation axis 113 passes, and attached to the lower bearing 161. Here, the downwardly-protruding peripheral portion of the lower bearing 161 and the flat peripheral portion of the lower cover 171 are bolt-fastened to the low pressure cylinder 121 at a time. For another example, in the lower bearing 161, a central portion into/in which the rotation axis 113 is inserted or installed protrudes in a downward direction and the other portion is flat. In the lower cover 171, a central portion provided with a hole through which the rotation axis 113 passes is flat, and a peripheral portion protrudes in an upward correction with a step difference. Here, the flat peripheral portion of the lower bearing 161 and the upwardly-protruding peripheral portion of the lower cover 171 with the step difference are bolt-fastened to the low pressure cylinder 121 at a time. In this case, the lower bearing 161 can be simplified in shape, thereby reducing the number of processes. Moreover, the lower cover 171 can be easily manufactured by means of a press process. The shapes and fastening methods of the lower bearing 161 and the lower cover 171 are not limited to the foregoing description. Further, although the middle pressure chamber $P_m$ is formed at the lower bearing 161 by way of example, the middle pressure chamber $P_m$ may be formed at any one of the upper bearing 162 and the middle plate 140.

A discharge port (not shown) is formed in an upper portion of the upper bearing 162 positioned on the high pressure compression assembly 130. High pressure refrigerant discharged from the high pressure compression assembly 130 through the discharge port of the upper bearing 162 is discharged to the outside through the refrigerant discharge tube 152 positioned at an upper portion of the hermetic container 101.

An inner passage 180 connected to cause refrigerant to flow from the low pressure compression assembly 120 to the high pressure compression assembly 130 is formed in the lower bearing 161, the low pressure compression assembly 120, the middle plate 140 and the high pressure compression assembly 130. The inner passage 180 is vertically formed to be parallel with an axis direction of the compressor 100.

Since the inner passage 180 is not a separate tube, the injection tube 153 (see FIG. 3) for introducing refrigerant gas separated in the phase separator 500 (see FIG. 3) may be installed in any portion of the inner passage 180. For example, a through hole (not shown) is formed in any one of the lower bearing 161, the middle plate 140 and the high pressure cylinder 131 defining the middle pressure chamber $P_m$, and the injection tube 153 is inserted into the through hole to introduce refrigerant gas, thereby improving compression efficiency.

FIG. 5 is a view illustrating the low pressure compression assembly of the 2 stage rotary compressor according to the present invention. The low pressure compression assembly 120 includes a low pressure cylinder 121, a low pressure eccentric portion 122, a low pressure roller 123, a low pressure vane 124, a low pressure elastic member 125, a low pressure inflow hole 126, and a middle pressure discharge hole 127. The rotation axis 113 passes through a central portion of the low pressure cylinder 121, and the low pressure eccentric portion 122 is fixed to the rotation axis 113. Here, the low pressure eccentric portion 122 may be integrally formed with the rotation axis 113. In addition, the low pressure roller 123 is rotatably installed on the low pressure eccentric portion 122, so that the low pressure roller 123 is rolled and rotated along an inner diameter of the low pressure cylinder 121 due to the rotation of the rotation axis 113. The low pressure inflow hole 126 and the middle pressure discharge hole 127 are formed at both sides of the low pressure vane 124. Moreover, a space inside the low pressure cylinder 121 is partitioned off by the low pressure vane 124 and the low pressure roller 123, so that refrigerant before compression and refrigerant after compression coexist in the low pressure cylinder 121. A portion partitioned by the low pressure vane 124 and the low pressure roller 123 and including the low pressure inflow hole 126 is referred to as a low pressure refrigerant inflow portion $S_l$, and a portion inducing the middle pressure discharge hole 127 is referred to as a middle pressure refrigerant discharge portion $D_m$. At this time, the low pressure elastic member 125 is a means for applying force to the low pressure vane 124 so that the low pressure vane 124 can be continuously in contact with the low pressure roller 123. A vane hole 124*h* formed in the low pressure cylinder 121 to position the low pressure vane 124 therein penetrates through the low pressure cylinder 121 in a horizontal direction. The low pressure vane 124 is guided through the vane hole 124, and the low pressure elastic member 125 imparting force to the low pressure vane 124 passes through the low pressure cylinder 121 and extends to the hermetic container 101 through the vane hole 124. One end of the low pressure elastic member 125 contacts the low pressure vane 124 and the other end thereof contacts the hermetic container 101 to push the low pressure vane 124 to be continuously in contact with the low pressure roller 123.

In addition, a middle pressure communication hole 120*a* is formed in the low pressure cylinder 121 so that refrigerant compressed in the low pressure compression assembly 120 can be introduced into the high pressure compression assembly 130 via the middle pressure chamber $P_m$ defined by the lower bearing 161. The middle pressure communication hole 120*a* is formed to avoid the refrigerant inflow tube 151 so that the middle pressure communication hole 120*a* can not overlap with the refrigerant inflow tube 151 inserted into the low pressure inflow hole 126, i.e., the inner passage 180 can not overlap with the refrigerant inflow tube 151. Even if the middle pressure communication hole 120*a* partially overlaps with the refrigerant inflow tube 151, it causes middle pressure refrigerant to flow from the middle pressure chamber $P_m$ to the high pressure compression assembly 130. However, in this case, a loss may occur as much as a sectional area of the inner passage 180 overlapping with the refrigerant inflow tube 151. In addition, since refrigerant bypasses the refrigerant inflow tube 151, a pressure may be lowered.

As shown in FIG. 5, when the low pressure eccentric portion 122 is rotated due to the rotation of the rotation axis 113 and the low pressure roller 123 is rolled along the low pressure cylinder 121, a volume of the low pressure inflow portion $S_l$ is increased, so that the low pressure inflow portion $S_l$ has a low pressure. Therefore, refrigerant is introduced through the low pressure inflow hole 126. Meanwhile, a volume of the middle pressure discharge portion $D_m$ is decreased, so that refrigerant filled in the middle pressure discharge portion $D_m$ is compressed and discharged through the middle pressure discharge hole 127. The volumes of the low pressure inflow portion $S_l$ and the middle pressure discharge portion $D_m$ are continuously changed according to the rotation of the low pressure eccentric portion 122 and the low pressure roller 123, and compressed refrigerant is discharged in every one rotation.

FIGS. 6 to 8 are views illustrating portions of the 2 stage rotary compressor according to one embodiment of the present invention. The lower bearing 161, the low pressure compression assembly 120, the middle plate 140 and the high pressure compression assembly 130 are successively stacked from the bottom. As described above, low pressure refrigerant is introduced into the low pressure cylinder 121 through the refrigerant inflow tube 151 and the low pressure inflow hole 126, compressed, and discharged to the middle pressure chamber $P_m$ which is a space restricted by a bottom surface of the low pressure compression assembly 120, the lower bearing 161 and the lower cover 171 through the middle pressure discharge hole 127. A middle pressure discharge hole 161*h* is formed in the lower bearing 161 to overlap with the middle pressure discharge hole 127, and a valve (not shown) is installed under the middle pressure discharge hole 161*h* of the lower bearing 161. When refrigerant compressed in the middle pressure discharge portion $D_m$ of the low pressure compression assembly 120 is compressed to a predetermined pressure, it is discharged to the middle pressure chamber $P_m$. The refrigerant discharged to the middle pressure chamber $P_m$ is introduced into the high pressure compression assembly 130 via the middle pressure communication hole 161*a* formed in the lower bearing 161, the middle pressure communication hole 120*a* formed in the low pressure cylinder 121, a middle pressure communication hole 140*a* formed in the middle plate 140 and a middle pressure inflow groove 130*a* formed in the high pressure cylinder 131. The middle pressure communication hole 161*a* of the lower bearing 161, the middle pressure communication hole 120*a* of the low pressure compression assembly 120, the middle pressure communication hole 140*a* of the middle plate 140 and the middle pressure inflow groove 130*a* of the high pressure compression assembly 130 define the inner passage 180 for middle pressure refrigerant compressed in the low pressure compression assembly 120. Here, the middle pressure inflow groove 130*a* of the high pressure compression assembly 130 is formed in the shape of an inclined groove to communicate with an inner space of the high pressure cylinder 131. Some lower portion of the middle pressure inflow groove 130*a* is in contact with the middle pressure communication hole 140*a* of the middle plate 140 to be a part of the inner passage 180. Compressed middle pressure refrigerant is introduced into the high pressure cylinder 131 through the middle pressure inflow groove 130*a*. When middle pressure refrigerant is supplied to the high pressure compression assembly 130 through the inner passage 180, the high pressure compression assembly 130 compresses the middle pressure refrigerant to a high pressure in the same operation principle as that of the low pressure compression assembly 120.

As set forth above, when the inner passage 180 for middle pressure refrigerant is not defined by a separate tube but formed in the hermetic container 101, noise can be suppressed and a length of the inner passage 180 can be reduced, so that a refrigerant pressure loss caused by a resistance can be reduced. In the above description, although the middle pressure chamber $P_m$ is formed at the lower bearing 161, it may be formed at any one of the upper bearing 162 and the middle plate 140. Accordingly, detailed configuration may be slightly changed. However, in every case, the inner passage 180 is formed in the 2 stage compression assembly to guide middle pressure refrigerant compressed in the middle pressure compression assembly 120 to the high pressure compression assembly 130. In this configuration, since a length of the passage for guiding middle pressure refrigerant is reduced, a flow loss can be minimized, and since refrigerant does not pass through a connection tube passing through the hermetic container 101, noise and vibration can be suppressed.

Here, in order to prevent the inner passage 180 from being blocked by the refrigerant inflow tube 151, the middle pressure communication hole 120*a* of the low pressure compression assembly 120, the middle pressure communication hole 140*a* of the middle plate 140 and the middle pressure inflow groove 130*a* of the high pressure compression assembly 130 constituting the inner passage 180 are spaced apart from the refrigerant inflow tube 151, as seen in an axis direction of the compressor 100.

The middle pressure communication hole 161*a* of the lower bearing 161 is formed to avoid an insertion position of the refrigerant inflow tube 151 connected to the low pressure cylinder 121 so that the middle pressure communication hole 161*a* can not be blocked by the refrigerant inflow tube 151. The refrigerant inflow tube 151 is inserted into the low pressure inflow hole 126 formed in the low pressure cylinder 121. The low pressure inflow hole 126 is adjacent to the low pressure vane insertion hole 124*h* into which the low pressure vane 124 (see FIG. 5) is to be inserted. As the low pressure inflow hole 126 is distant from the low pressure vane 124 (shown in FIG. 5), a dead volume which does not contribute to compression of refrigerant is increased in an inner space of the low pressure cylinder 121.

In addition, the middle pressure inflow groove 130*a* of the high pressure cylinder 131 is not formed from the lower to upper portions of the high pressure cylinder 131, but inclinedly formed from the lower portion to the inner space of the high pressure cylinder 131. Here, the middle pressure inflow groove 130*a* is adjacent to a high pressure vane hole 134*h* into which a high pressure vane (not shown) is to be inserted. As in the low pressure compression assembly 120, when the middle pressure inflow groove 130*a* is adjacent to the high pressure vane (not shown), a dead volume is reduced in the inner space of the high pressure cylinder 131.

The low pressure vane 124 and the high pressure vane (not shown) are positioned on the same axis. Accordingly, the middle pressure communication hole 161*a* formed in the lower bearing 161 and the middle pressure inflow groove 130*a* formed in the high pressure cylinder 131 are not formed on the same axis, but spaced apart from each other in a horizontal direction. According to a third embodiment of the present invention, the middle pressure communication hole 120*a* of the low pressure cylinder 121 and the middle pressure communication hole 140*a* of the middle plate 140 are formed in a spiral shape to connect the middle pressure communication hole 161*a* of the lower bearing 161 to the middle pressure inflow groove 130*a* of the high pressure cylinder 131. The middle pressure communication hole 120*a* of the low pressure cylinder 121 and the middle pressure communication hole 140*a* of the middle plate 140 are formed in a spiral shape to overlap with each other. That is, the middle pressure communication hole 120*a* of the low pressure cylinder 121 and the middle pressure communication hole 140*a* of the middle plate 140 overlap with each other to define a spiral communication hole. At this time, one end of the spiral communication hole overlaps with the middle pressure communication hole 161*a* of the lower bearing 161, and the other end thereof overlaps with the middle pressure inflow groove 130*a* of the high pressure cylinder 131. Here, one end of the middle pressure communication hole 120*a* of the low pressure cylinder 121 is connected to the middle pressure communication hole 161*a* of the lower bearing 161. That is, one end of the middle pressure communication hole 120*a* of the low pressure cylinder 121 which is in contact with the middle pressure communication hole 161*a* of the lower bearing 161 is formed in a vertical direction of the low pressure cylinder 121, and the other portion of the middle pressure communication hole 120*a* is entirely formed in a spiral shape as a bottom end thereof is gradually heightened from one end to the other end. On the contrary, the other end of the middle pressure communication hole 140*a* of the middle plate 140, i.e., the other end of the spiral communication hole overlapping with the middle pressure inflow groove 130*a* of the high pressure cylinder 131 is formed in a vertical direction of the middle plate 140. In addition, the middle pressure communication hole 140*a* is entirely formed in a spiral shape as a top end thereof is gradually heightened from one end overlapping with the middle pressure communication hole 161*a* of the lower bearing 161 to the other end.

In a case where the middle pressure communication hole 120*a* of the low pressure cylinder 121 and the middle pressure communication hole 140*a* of the middle plate 140 are formed in a spiral shape, when refrigerant flows through the middle pressure communication hole 120*a* of the low pressure cylinder 121 and the middle pressure communication hole 140*a* of the middle plate 140, a resistance imparted to the refrigerant is reduced. Meanwhile, the middle pressure communication hole 120*a* of the low pressure cylinder 121 and the middle pressure communication hole 140*a* of the middle plate 140 may be formed in a circular arc shape with a constant top or bottom end height as well as in a spiral shape.

Moreover, when the middle pressure communication hole 120*a* of the low pressure cylinder 121 and the middle pressure communication hole 140*a* of the middle plate 140 are formed in a spiral or circular arc shape, fastening holes 120*b* and 140*b* may be formed in central portions of the spiral or circular arc-shaped middle pressure communication holes 120*a* and 140*a*. Normally, the lower bearing 161, the low pressure cylinder 121, the middle plate 140, the high pressure cylinder 131 and the upper bearing 162 are fastened by means of bolts. Here, bolt fastening holes 161*b*, 120*b*, 130*b*, 140*b* and 162*b* should be formed to avoid various members and the inner passage, such as the refrigerant inflow tube 151, the middle pressure communication holes 161*a*, 120*a*, 140*a* and 162*a*, the middle pressure inflow groove 130*a* and the middle pressure discharge hole 127. In addition, the fastening holes 161*b*, 120*b*, 130*b*, 140*b* and 162*b* should be formed in at least three positions to evenly disperse a fastening force to the entire compression assembly 105. At this time, the middle pressure communication hole 120*a* of the low pressure cylinder 121 and the middle pressure communication hole 140*a* of the middle plate 140 are longer than the middle pressure communication hole 161*a* of the lower bearing 161 and the middle pressure inflow groove 130*a* of the high pressure cylinder 131, which makes it difficult to form the fastening holes 161*b*, 120*b*, 130*b*, 140*b* and 162*b* in a plural number. Accordingly, when the middle pressure communication hole 120*a* of the low pressure cylinder 121 and the middle pressure communication hole 140*a* of the middle plate 140 are formed in a spiral or circular arc shape, since the fastening holes 161*b*, 120*b*, 130*b*, 140*b* and 162*b* are formed in the centers of the spiral or circular arc shapes, the fastening holes 161*b*, 120*b*, 130*b*, 140*b* and 162*b* can be dispersively arranged in the entire compression assembly 105.

FIG. 9 is a view illustrating one example of the rotation axis provided in the 2 stage rotary compressor according to the present invention. A low pressure eccentric portion 122 and a high pressure eccentric portion 132 are coupled to the rotation axis 113. In order to reduce vibration, the low pressure eccentric portion 122 and the high pressure eccentric portion 132 are generally coupled to the rotation axis 113 with a phase difference of 180°. In addiction, the rotation axis 113 is a hollow axis, and oil communication holes 103*a* are formed below the low pressure eccentric portion 122 and over the high pressure eccentric portion 132. Moreover, a thin-plate stirrer 103*b* bent in a spiral shape is inserted into the hollow rotation axis 113. The stirrer 103*b* is fitted into the rotation axis 113 and rotated with the rotation axis 113 during the rotation of the rotation axis 113. When the stirrer 103*b* is rotated due to the rotation of the rotation axis 113, oil filled in a lower portion of the hermetic container 101 (see FIG. 4) is lifted along the inside of the rotation axis 113 by means of the stirrer 103*b*. Some oil is discharged to the low pressure cylinder 121, the middle plate 140 and the high pressure cylinder 131 through the oil communication holes 103*a* formed in the rotation axis 113, thereby lubricating the low pressure roller 123 (see FIG. 5) and a high pressure roller (not shown).

FIG. 10 is a view illustrating a compressor with an injection tube inserted thereinto according to a first embodiment of the present invention. In a 2 stage compressor 100 according to the present invention, since an inner passage 180 is not a separate tube, an injection tube 153 for injecting refrigerant gas separated in a phase separator 500 may be installed in any portion of the inner passage 180. For example, a through hole 153*h* is formed in any one of a lower bearing 161, a middle plate 140 and a high pressure cylinder 131 constituting a middle pressure chamber $P_m$, and the injection tube 153 is inserted into the through hole 153*h* so as to inject refrigerant gas. As shown in FIG. 8, in a state where the through hole 153*h* is formed to pass through a middle pressure discharge hole 127 of a low pressure cylinder 121 or formed in the lower bearing 161, when the injection tube 153 is inserted into the through hole 153*h*, a pressure loss occurs along the middle pressure chamber $P_m$ and the inner passage 180. However, although liquid phase refrigerant is introduced through the injection tube 153, it is collected in a lower portion of the middle pressure chamber $P_m$, so that the compressor 100 can be stably operated.

FIG. 11 is a view illustrating a lower bearing having a first discharge port according to the first embodiment of the present invention. The lower bearing 161 includes a first discharge port 161*p*, a middle pressure communication hole 161*a*, a fastening hole 161*b*, a rotation axis through hole 161*c*, a discharge valve fastening hole 161*d* and a discharge valve reception groove 161*e*.

According to the first embodiment of the present invention, a 2 stage compression assembly 105 (see FIG. 4), wherein a low pressure compression assembly 120 (see FIG. 4), a middle plate 140 (see FIG. 4) and a high pressure compression assembly 130 (see FIG. 4) are successively stacked from the bottom, is accommodated in a hermetic container 101 (see FIG. 4).

In addition, the compressor 100 includes the lower bearing 161 under the low pressure compression assembly 120 (see FIG. 4), and a lower cover 171 (see FIG. 4) under the lower bearing 161. Here, a space between the lower bearing 161 and the lower cover 171 serves as the middle pressure chamber $P_m$. The first discharge port 161*p* is formed in a top surface of the lower bearing 161, i.e., a surface which is in contact with a bottom surface of the low pressure compression assembly 120 (see FIG. 4). Middle pressure refrigerant compressed in the low pressure compression assembly 120 (see FIG. 4) is introduced into the middle pressure chamber $P_m$ through the middle pressure discharge hole 127 (see FIG. 5) formed in the low pressure cylinder 121 (see FIG. 5) and the first discharge port 161*p*, and guided to the high pressure compression assembly 130 (see FIG. 4) through the inner passage 180 (see FIG. 4).

Moreover, a discharge valve (not shown) for opening and closing the first discharge port 161*p* is provided on the top surface of the lower bearing 161. For example, the discharge valve (not shown) is a thin valve. One end of the discharge valve (not shown) is fastened to the lower bearing 161 by a fastening member. Therefore, the lower bearing 161 includes the fastening hole 161*d* to which the discharge valve (not shown) is to be fastened. Moreover, the lower bearing 161 includes the discharge valve reception groove 161*e* for receiving the discharge valve (not shown). The discharge valve (not shown) is set to open the discharge port 161*p* over a predetermined pressure. Here, the pressure imparted to the discharge valve (not shown) is the sum of a positive pressure by a discharge stroke of the low pressure compression assembly 120 (see FIG. 4) and a negative pressure by a suction stroke of the high pressure compression assembly 130 (see FIG. 4).

FIG. 12 is a view illustrating an upper bearing having a second discharge port according to the first embodiment of the present invention. An upper bearing 162 includes a second discharge port 162*p*, a fastening hole 162*b*, a rotation axis through hole 162*c*, a discharge valve fastening hole 162*d* and a discharge valve reception groove 162*e*. According to the first embodiment of the present invention, the upper bearing 162 is positioned on the 2 stage compression assembly 105 (see FIG. 4), and stacked so that a top surface of the high pressure compression assembly 130 and a bottom surface of the upper bearing 162 can be in contact with each other. The second discharge port 162*p* for discharging high pressure refrigerant compressed in the high pressure compression assembly 130 is formed in the upper bearing 162. In addition, an upper cover 172 (see FIG. 4) is positioned on the upper bearing 162, and a space defined by the upper bearing 162 and the upper cover 172 (see FIG. 4) functions as a muffler for reducing pulsation, vibration and noise.

A thin discharge valve (not shown) is formed on the second discharge port 162*p* to open and close the second discharge port 162*p* like the first discharge port 161*p* (see FIG. 11). The upper bearing 162 includes the discharge valve fastening hole 162*d* to which the discharge valve (not shown) is to be fastened, and the discharge valve reception groove 162*e* for receiving the discharge valve (not shown) when the discharge valve (not shown) closes the second discharge port 162*p*. The discharge valve (not shown) opens the second discharge port 162*p* over a set pressure. High pressure refrigerant compressed in the high pressure compression assembly 130 (see FIG. 4) is pulsation-reduced in the space between the upper bearing 162 and the upper cover 172 (see FIG. 4) due to opening of the second discharge port 162*p*, and discharged to the hermetic container 101 (see FIG. 4).

Referring to FIGS. 11 and 12 the first discharge port 161*p* and the second discharge port 162*p* are generally formed in the shape of a cylindrical hole due to processing convenience. Therefore, volumes of the first discharge port 161*p* and the second discharge port 162*p* can be easily computed by a formula of computing a volume of a cylinder. That is, the volumes of the first discharge port 161*p* and the second discharge port 162*p* can be computed by inner diameters and heights thereof.

FIGS. 13 to 15 are graphs showing variations of an EER of the 2 stage rotary compressor by variations of a volume ratio and an inner diameter ratio between the discharge port and the cylinder, and variations of an inner diameter ratio between the first discharge port and the second discharge port, respectively.

The EER of the 2 stage compressor is measured in Ashrae-T and ARI conditions.

Ps (suction pressure): 5.34 kg/cm$^2$

Pd (discharge pressure): 20.86 kg/cm$^2$

Condensing temperature: 54.4° C.

Evaporating temperature: 7.2° C.

Liquid sub cooled temperature: 46.1° C.

Suction temperature (Ashrae-T): 35° C.

Suction temperature (ARI): 18.3° C.

Referring to FIG. 13, as the ratio of the volume of the discharge port to the volume of the cylinder increases, the EER increases. When the volume of the discharge port exceeds 1.8% of the volume of the cylinder, the EER starts to decrease.

In a case where the volume of the discharge port is excessively large with respect to the volume of the cylinder, for example, refrigerant is not discharged but left in a discharge stroke of the low pressure compression assembly 120 (see FIG. 4) as much as the sum of the volume of the discharge port and the volume of the middle pressure discharge hole 127 (see FIG. 5) of the low pressure cylinder 121 (see FIG. 6). Therefore, middle pressure refrigerant remaining in the discharge port and the middle pressure discharge hole 127 is re-expanded and compressed in a suction stroke of the low pressure compression assembly 120 (see FIG. 4), thereby causing a loss of energy efficiency.

Meanwhile, in a case where the volume of the discharge port is excessively small with respect to the volume of the cylinder, when compressed middle pressure refrigerant is discharged, a resistance occurs. Since the compressed middle pressure refrigerant is not smoothly discharged, a pressure of a compression space inside the cylinder is excessively raised, so that the compression assembly has overload. It also causes a loss of energy efficiency.

Accordingly, the ratio of the volume of the discharge port to the volume of the cylinder is preferably restricted within a range larger than 0.5% and smaller than 2.5%, more preferably, larger than 1.0% and smaller than 2.0%. Here, the volume ratio between the first discharge port and the low pressure cylinder and the volume ratio between the second discharge port and the high pressure cylinder are restricted within the aforementioned range.

Referring to FIG. 14, the ratio of the inner diameter of the discharge port to the inner diameter of the cylinder is preferably restricted due to the aforementioned reasons. The ratio of the inner diameter of the discharge port to the inner diameter of the cylinder is preferably larger than 10% and smaller than 25%, and more preferably, larger than 15% and smaller than 23%. In this configuration, the design reference value can be established, restricting the ratio of the inner diameter of the discharge port to the inner diameter of the cylinder before/after 20% to maximize the EER.

Referring to FIG. 15, the ratio of the inner diameter of the second discharge port to the inner diameter of the first discharge port is also restricted within a predetermined range. In case of the 2 stage rotary compressor, a volume flow of refrigerant compressed in the low pressure compression assembly is substantially larger than a volume flow of refrigerant compressed in the high pressure compression assembly. Therefore, a height of the low pressure cylinder is larger than a height of the high pressure cylinder, so that a compression space of the low pressure cylinder is wider than a compression space of the high pressure cylinder. In addition, a volume flow of middle pressure refrigerant compressed in and discharged from the low pressure compression assembly is larger than a volume flow of high pressure refrigerant compressed in and discharged from the high pressure compression assembly. Accordingly, the inner diameter of the first discharge port discharging middle pressure refrigerant compressed in the low pressure compression assembly should be larger than or at least equal to the inner diameter of the second discharge port discharging high pressure refrigerant compressed in the high pressure compression assembly. On the other hand, in a case where the second discharge port is excessively smaller than the first discharge port, a flow resistance is imparted to high pressure refrigerant discharged through the second discharge port, so that the high pressure compression assembly has overload. Therefore, the size of the second discharge port should be larger than or at least equal to 0.5 times of the size of the first discharge port.

In this configuration, the design reference values of the first discharge port and the second discharge port can be established, maximizing efficiency of the 2 stage compressor, wherein refrigerant is primarily compressed in the low pressure compression assembly and secondarily compressed in the high pressure compression assembly. As set forth above, the discharge ports of the compressor are not portions manually discharging compressed refrigerant. Energy efficiency of the compressor is changed according to the size ratio between the discharge port and the cylinder and the size ratio between the discharge ports. In addition, since two compression elements are coupled to one rotation axis with a phase difference of 180° and rotated to compress refrigerant in the 2 stage compressor, the design of the discharge ports greatly influences efficiency of the compressor. According to the present invention, efficiency of the compressor can be maximized by restricting the sizes of the first and second discharge ports without changing the other constituent elements.

The schematic operation principle of the 2 stage rotary compressor according to one embodiment of the present invention will be explained with reference to FIGS. 3 to 12.

Refrigerant circulated in the freezing cycle is temporarily stored in the accumulator 200 before being introduced into the compressor 100. The accumulator 200 serves as a temporary storage space of refrigerant and functions as a gas-liquid separator to introduce only gas into the compressor 100. Gaseous refrigerant flows from the accumulator 200 to the low pressure cylinder 121 of the low pressure compression assembly 120 through the refrigerant inflow tube 151. The refrigerant inflow tube 151 penetrates through the hermetic container 101 and is fixed to the hermetic container 101 by means of welding. In addition, the refrigerant inflow tube 151 is inserted into the refrigerant inflow hole 126 formed in the low pressure cylinder 121. The refrigerant inflow hole 126 is formed to reach the inner diameter of the low pressure cylinder 121. The refrigerant introduced into the inner space of the low pressure cylinder 121 through the refrigerant inflow hole 126 is compressed by volume variations of the spaces defined by the low pressure cylinder 121, the low pressure roller 123 and the low pressure vane 124 due to relative motion of the low pressure cylinder 121 and the low pressure roller 123. The compressed refrigerant is transferred from the low pressure cylinder 121 to the high pressure cylinder 131 through the inner passage 180, and compressed by the high pressure compression assembly 130.

The inner passage 180 is connected to cause middle pressure refrigerant to flow from the low pressure cylinder 121 to the high pressure cylinder 131 by way of the middle pressure discharge hole 127 of the low pressure cylinder 121, the middle pressure chamber $P_m$, the middle pressure communication hole 161*a* of the lower bearing 161, the middle pressure communication hole 120*a* of the low pressure cylinder 121, the middle pressure communication hole 140*a* of the middle plate 140, and the middle pressure inflow groove 130*a* of the high pressure cylinder 131. Here, the middle pressure chamber $P_m$ may be replaced by a pipe or may be omitted.

That is, the refrigerant compressed by the low pressure compression assembly 120 is discharged to the middle pressure chamber $P_m$ formed below the low pressure cylinder 121 through the middle pressure discharge hole 127 formed in the low pressure cylinder 121. The middle pressure chamber $P_m$ is defined by the lower bearing 161 and the lower cover 171. In addition, the middle pressure discharge hole 161*h* is formed in the lower bearing 161 to overlap with the middle pressure discharge hole 127 of the low pressure cylinder 121. Moreover, a valve 191 for opening and closing the middle pressure discharge hole 161*h* is installed on the lower bearing 161. The valve 191 opens the middle pressure discharge hole 127 of the low pressure cylinder 121 and the middle pressure discharge hole 161*h* of the lower bearing 161 over a set pressure. Middle pressure refrigerant discharged to the middle pressure chamber $P_m$ due to opening of the valve 191 is introduced into the inner space of the high pressure cylinder 131 through the middle pressure communication hole 161*a* of the lower bearing 161, the middle pressure communication hole 120*a* of the low pressure cylinder 121, the middle pressure communication hole 140*a* of the middle plate 140 and the middle pressure inflow groove 130*a* of the high pressure cylinder 131. Here, the injection tube 153 is connected to the middle pressure communication hole 120*a* of the low pressure cylinder 121 so as to inject gaseous refrigerant separated in the phase separator 500 into the inner passage 180. Refrigerant separated in the phase separator 500 has a higher pressure than refrigerant passing through the evaporator 400. Therefore, when the refrigerant separated in the phase separator 500 is introduced into the high pressure compression assembly 130 with the refrigerant compressed in the low pressure compression assembly 120, compressed and discharged, input power of the compressor 200 can be reduced.

The refrigerant separated in the phase separator 500 and the refrigerant compressed in the low pressure compression assembly 120 are introduced into the high pressure cylinder 131 through the middle pressure inflow groove 130*a* of the high pressure cylinder 131, and compressed to a high pressure by the high pressure compression assembly 130 in the same operation principle as that of the low pressure compression assembly 120. The refrigerant compressed to a high pressure in the high pressure compression assembly 130 is discharged to a discharge space D defined between the upper bearing 162 and the upper cover 172 through a high pressure discharge hole 137 of the high pressure cylinder 131 and a high pressure discharge hole 162*h* of the upper bearing 162. Here, a valve 192 is installed on the upper bearing 162 to open and close the high pressure discharge hole 137 of the high pressure cylinder 131 and the high pressure discharge hole 162*h* of the upper bearing 162. Accordingly, only when refrigerant is compressed in the high pressure compression assembly 130 over a predetermined pressure, the valve 192 opens the high pressure discharge hole 137 of the high pressure cylinder 131 and the high pressure discharge hole 162*h* of the upper bearing 162, thereby discharging refrigerant to the discharge space D. High pressure refrigerant is temporarily stored in the dicharge space D, and then discharged to the top of the hermetic container 101 through the discharge port 172*p* of the upper cover 172. The high pressure refrigerant is filled in the hermetic container 101. The high pressure refrigerant filled in the hermetic container 101 is discharged to the outside through the discharge tube 152 passing through the upper portion of the hermetic container 101, circulated in the freezing cycle, introduced into the compressor 100 again through the accumulator 200 and the phase separator 500, and compressed in the compressor 100.

Moreover, lubrication oil for lubricating the compression assembly 105 is filled in the lower portion of the hermetic container 101. The lubrication oil is lifted along the inside of the rotation axis 113 due to the rotation of the stirrer 103*b* inserted into the rotation axis 113, and supplied to the low pressure compression assembly 120 and the high pressure compression assembly 130 through the oil communication holes 103*a* formed in the rotation axis 113 to lubricate the compression assembly 105. Further, the oil may be supplied to the low pressure compression assembly 120 and the high pressure compression assembly 130 through the vane holes 124*h* and 134*h* formed in the low pressure cylinder 121 and the high pressure cylinder 131 to lubricate the compression assembly 105.

The invention claimed is:

1. A 2 stage rotary compressor, comprising:

a hermetic container that defines an outward appearance of the compressor;

a 2 stage compression assembly provided in the hermetic container, wherein a low pressure cylinder, a middle plate, and a high pressure cylinder are successively stacked from any one of upper and lower portions;

a first discharge port that discharges refrigerant compressed in the low pressure cylinder; and a second discharge port that discharges refrigerant compressed in the high pressure cylinder, wherein a diameter of the second discharge port ranges from 0.5 times to 1.0 times a diameter of the first discharge port, and wherein the first discharge port has an inner volume equivalent to 0.5% to 2.5% of an inner volume of the low pressure cylinder.

2. The 2 stage rotary compressor of claim 1, wherein the inner volume of the first discharge port is equivalent to 1.0% to 2.0% of the inner volume of the low pressure cylinder.

3. The 2 stage rotary compressor of claim 1, wherein the first discharge port has an inner diameter equivalent to 10% to 25% of an inner diameter of the low pressure cylinder.

4. The 2 stage rotary compressor of claim 3, wherein the inner diameter of the first discharge port is equivalent to 15% to 23% of the inner diameter of the low pressure cylinder.

5. The 2 stage rotary compressor of claim 1, further comprising a first bearing positioned at any one of upper and lower portions of the low pressure cylinder, wherein the first discharge port is formed in the first bearing.

6. The 2 stage rotary compressor of claim 5, further comprising a second bearing positioned at any one of upper and lower portions of the high pressure cylinder, wherein the second discharge port is formed in the second bearing.

7. A 2 stage rotary compressor comprising:

a hermetic container that defines an outward appearance of the compressor;

a 2 stage compression assembly provided in the hermetic container, wherein a low pressure cylinder, a middle plate, and a high pressure cylinder are successively stacked from any one of upper and lower portions;

a first discharge port that discharges refrigerant compressed in the low pressure cylinder; and a second discharge port that discharges refrigerant compressed in the high pressure cylinder, wherein a diameter of the second discharge port ranges from 0.5 times to 1.0 times a diameter of the first discharge port, and wherein the second discharge port has an inner volume equivalent to 0.5% to 2.5% of an inner volume of the high pressure cylinder.

8. The 2 stage rotary compressor of claim 7, wherein the inner volume of the second discharge port is equivalent to 1.0% to 2.0% of the inner volume of the high pressure cylinder.

9. The 2 stage rotary compressor of claim 7, wherein the second discharge port discharges refrigerant compressed in the high pressure cylinder, and has an inner diameter equivalent to 10% to 25% of an inner diameter of the high pressure cylinder.

10. The 2 stage rotary compressor of claim 9, wherein the inner diameter of the second discharge port is equivalent to 15% to 23% of the inner diameter of the high pressure cylinder.

11. The 2 stage rotary compressor of claim 7, further comprising a first bearing positioned at any one of upper and lower portions of the low pressure cylinder, wherein the first discharge port is formed in the first bearing.

12. The 2 stage rotary compressor of claim 11, further comprising a second bearing positioned at any one of upper and lower portions of the high pressure cylinder, wherein the second discharge port is formed in the second bearing.

* * * * *